United States Patent [19]

Ferrari

[11] 3,989,410

[45] Nov. 2, 1976

[54] LABYRINTH SEAL SYSTEM

[75] Inventor: Bartolomeo Joseph Ferrari, Topsfield, Mass.

[73] Assignee: General Electric Company, Lynn, Mass.

[22] Filed: Nov. 27, 1974

[21] Appl. No.: 527,748

[52] U.S. Cl. ..... 415/115; 415/116; 415/174; 415/175; 415/172 A

[51] Int. Cl.[2] ..... F01D 5/20; F01D 11/02

[58] Field of Search ..... 415/115, 116, 174, 175, 415/172 A

[56] References Cited

UNITED STATES PATENTS

| | | | |
|---|---|---|---|
| 2,963,268 | 12/1960 | Smile et al. | 415/110 |
| 3,452,542 | 7/1969 | Saferstein et al. | 415/115 X |
| 3,527,053 | 9/1970 | Horn | 415/174 X |
| 3,532,399 | 10/1970 | Gray | 308/36.4 |
| 3,551,068 | 12/1970 | Scalzo et al. | 415/115 X |
| 3,565,545 | 2/1971 | Bobo et al. | 415/175 X |
| 3,635,586 | 1/1972 | Kent | 415/115 X |
| 3,746,462 | 7/1973 | Fekuda | 415/115 |

FOREIGN PATENTS OR APPLICATIONS

| | | | |
|---|---|---|---|
| 995,189 | 6/1965 | United Kingdom | 415/174 |

*Primary Examiner*—Arnold Rosenthal
*Attorney, Agent, or Firm*—James W. Johnson, Jr.; Derek P. Lawrence

[57] ABSTRACT

Undesired leakage from a system of labyrinth seals used to retain turbine cooling air is reduced by providing passageways which direct all parasitic leakage to a point between the teeth of one of the seals in the system.

7 Claims, 1 Drawing Figure

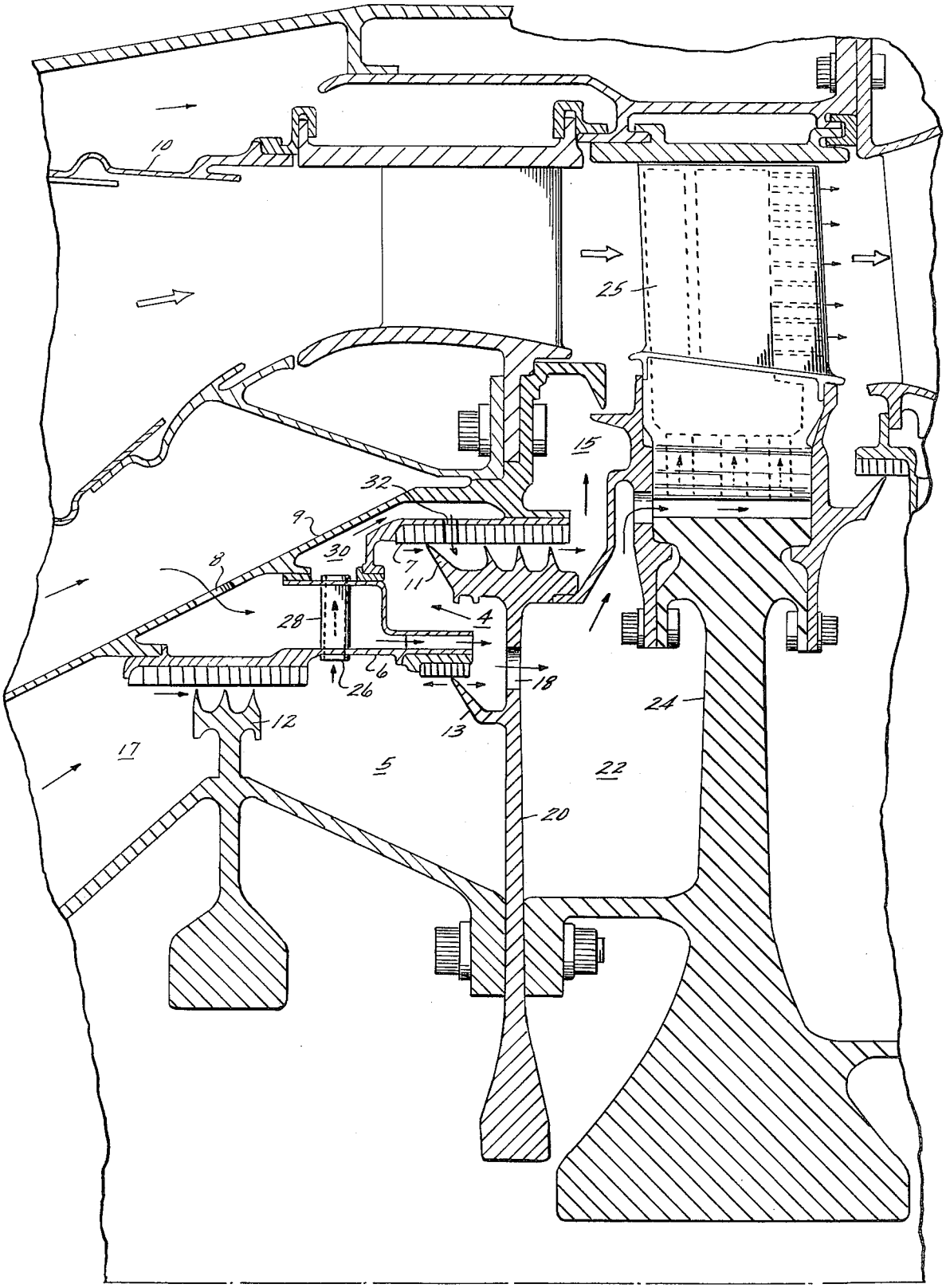
10
25
15
32
9
30
8
7
11
4
28
6
26
18
13
12
24
17
5
22
20

LABYRINTH SEAL SYSTEM

The invention herein described was made in the course or, or under a Government contract or subcontract thereunder (or grant), with the United States Air Force.

BACKGROUND OF THE INVENTION

1. Field of the Invention

This invention relates generally to improvements in gas turbine engines and, more particularly, to improvements in sealing the annular gas chambers which retain turbine cooling air against parasitic leakage.

2. Description of the Prior Art

It is a common practice in gas turbine engines to use a portion of the compressor discharge for engine cooling. A portion of the air used for this purpose is directed to a gas accelerator, well known in the art, which accelerates the air through a pressure decrease and swirls it in the direction of enginge rotation. The swirled gases are discharged into an annular chamber. In addition to receiving the swirled cooling air, this chamber may also be used in the manner well known in the art to provide a balancing force on the engine, in which case it may be referred to as the balance piston chamber. The chamber is sealed from adjacent areas of differing pressure by a system of gas seals placed at the junctures between rotating and stationary elements within the chamber. Gas seals outside the chamber have also been used to further minimize airflow between the chamber and adjacent areas of differing pressure.

Gas seals, as herein contemplated, are of the labyrinth type, comprising one or more circumferential teeth on one part which are contiguous with a circumferential sealing surface on another part, with the two parts or elements being relatively rotatable. Such a seal provides a high restriction to gas flow and has the further advantage of permitting rotation between the two parts of the seal. This type of seal has many other well known advantages and is widely used in gas turbin engines.

A disadvantage of seals of this type is that they are subject to parasitic leakage in the direction of decreasing pressure. When such seals are used to retain cooling air for high temperature gas turbines, such leakage is particularly undesirable since it reduces the thermodynamic efficiency of the engine.

Heretofore it has been the practice to direct the leakage of the individual gas seals separately in a parallel fashion to adjacent areas of lower pressure. The total leakage of such systems is the combined leakage of all the seals present in the system.

It is the object of the present invention to improve the thermodynamic efficiency of gas turbine engines by reducng the total leakage of the gas seals used to retain turbine cooling air.

SUMMARY OF THE INVENTION

Total system parasitic leakage is reduced by providing passageways which direct all parasitic leakage of the gas seals in the system to a point between the teeth of one of the seals in the system, such that the seal leakages flow in series rather than in a parallel manner.

This and other related objects and features of the present invention will be apparent from the reading of the following description found in the accompanying drawing and the novelty thereof pointed out in the appended claims.

DESCRIPTION OF THE DRAWINGS

While the specification concludes with claims distinctly claiming and particularly pointing out the invention described herein, it is believed that the invention will be more readily understood by reference to the discussion below and the accompanying drawing which depicts a vertical cross-sectional view of a cooling air accelerator and balance piston chamber for a gas turbine engine embodying the labyrinth seal system of the present invention.

DESCRIPTION OF THE PREFERRED EMBODIMENT

Referring to the Figure, there is shown a parital cross-section of a gas turbine engine illustrating the labyrinth seal system of the present invention. An annular chamber 4 is pressurized by relatively high pressure air derived from an annular accelerator 6. Chamber 4 is also used to provide a balancing force on the engine in the manner well known in the art and hence may be referred to as a balance piston chamber.

Accelerator 6 receives a portion of the air discharged from the compressor of the gas turbine engine via a plurality of apertures 8 in combustor casing 9 surrounding the annular combustor 10. The chamber 4 is defined by stationary portions including accelerator 6 and annular seal runner 7 which are rigidly secured to the combustor casing 9 and by rotating portions including the toothed members of labyrinth seals 11 and 13 and seal support disk 20. The chamber 4 is sealed against leakage to the adjacent lower pressure annular chamber 15 by the labyrinth seal 11. Chamber 4 is sealed against airflow from the higher pressure compressor discharge passage 17 by an outer labyrinth seal 12 and an inner labyrinth seal 13. Seal 13 separates the chamber 4 from an adjacent annular chamber 5.

In the manner well known in the art, the proper balancing force on the engine is maintained by adjusting the leakage across seal 13 such that the respective pressures of the balance piston chamber 4 and the outer adjacent chamber 5 are equalized. Accordingly, the leakage across seal 13 may flow in either direction across the teeth of seal 13, dependent on the instantaneous pressure difference between the balance piston chamber 4 and the chamber 5.

A portion of the air discharged from accelerator 6 is directed through a plurality of apertures 18 in the annular supporting disc 20 for seals 11 and 13 to another annular chamber 22 in order to provide cooling air to the turbine blade 24.

The present invention is, in its specific aspects herein illustrated, directed to minimizing the leakage of air from the chamber 4 into chamber 15 from the compressor discharge passage 17 into the chamber 4. This is accomplished by providing a plurality of passages which direct the parasitic leakages from seals 11, 12 and 13 to a point between the teeth of seal 11. Thus, as illustrated by the direction of the arrows in the Figure, leakage from the seals 12 and 13 into the chamber 5 is caused to flow through the respective openings 26 in the plurality of tubes 28 circumferentially placed around the inlet of accelerator 6, through the lower pressure annulr passage 30, into a plurality of apertures 32 in the seal runner 7, and thereafter deposit in the cavity, as illustrate, between the first and second teeth of seal 11. Similarly, the parasitic leakage from seal 13, which may flow into chamber 4, will flow in the direction of the decreasing pressure across the first tooth of seal 11 to join the leakage flow from passage 30.

While apertures 32 in seal runner 7 have been positioned to cause the leakage from passage 30 to flow to a point between the first and second teeth of seal 11, it will be apparent to those skilled in the art that apertures 32 may be positioned at different points on seal runner 32 to thereby cause the leakage from passage 30 to flow between different teeth of seal 11.

As herein illustrated, the total system leakage of the chambers 4 and 5 is the leakage which flows throught the last three downstream teeth of seal 11. Such leakage is substantially less than that of conventional cooling air chamber sealing systems wherein the total system leakage is that of the combined leakage of each of the separate seals used to seal the chamber.

While the invention has been discussed in terms of sealing the chamber for retaining the turbine cooling air of a gas turbine engine, the technique and apparatus of the present invention also has general applicability to any passages or chambers which use a system of labyrinth seals to maintain pressures. The technique of the present invention could be used with any turbomachinery in order to retain a maximum amount of cooling air and thereby maximize the thermodynamic efficiency of the machinery. The scope of the invention concept, therefore, is solely to be derived from the following claims.

Having described the invention, what is claimed as novel and desired to be secured by Letters Patent of the United States is:

1. An improved gas turbine engine comprising a compressor, combustor, and gas turbine in serial flow relation, a rotor drivably connected to the gas turbine for driving the compressor, a first annular chamber for retaining cooling air, and a gas accelerator providing accelerated cooling air to the first chamber having an input in flow communciation with the compressor, and an output in flow communication with the first chamber, wherein the improvement comprises:

a system of labyrinth seals for sealing the first chamber against leakage to and from adjacent areas of differing pressure, each seal having a toothed member in rotating engagement with a fixed runner;

flow passage means for causing the leakages of all the seals to flow to a point between the teeth of a first one of the seals wherein the flow passage means includes a plurality of tubes circumferentially spaced about the input to the accelerator, each tube having an inlet disposed to receive parasitic leakage from the remaining seals and an outlet in flow communication with at least one aperture in the runner of the first seal.

2. The gas turbine engine of claim 1 further comprising:

a second annular chamber upstream and adjacent the first chamber;

a compressor discharge passage in flow communication with the compressor and upstream and adjacent the second chamber, and a third annular chamber in flow communication with the combustor and downstream and adjacent the first chamber;

an annular flow passage adjacent the accelerator and first chamber.

3. The gas turbine engine of claim 2 wherein:

the first labyrinth seal separates the first chamber and the third chamber;

a second labyrinth seal separates the second chamber and the compressor discharge passage, and a thrid labyrinth seal separates the first chamber and the second chamber.

4. A gas turbine engine as claimed in claim 3 wherein at least one wall of the second flow passage is formed by the runner of the first labyrinth seal.

5. The gas turbine engine of claim 1 wherein the first annular chamber is a balance piston chamber.

6. The gas turbine engine of claim 4 wherein each tube has its inlet in flow communication with the second annular chamber and its outlet in flow communication with the annular flow passage and further comprising a plurality of apertures circumferentially spaced around the runner of the first seal opposite a point between two of the teeth of the first seal such that parasitic leakage flows through the annular flow passage and thereafter between the first and second teeth of the first seal.

7. A gas turbine engine as claimed in claim 6 wherein the apertures in the seal runner of the first labryinth seal are located at a point between the two upstream teeth of the first labyrinth seal.

* * * * *

UNITED STATES PATENT OFFICE
CERTIFICATE OF CORRECTION

PATENT NO. : 3,989,410
DATED : November 2, 1976
INVENTOR(S) : Bartolomeo Joseph Ferrari It is certified that error appears in the above-identified patent and that said Letters Patent are hereby corrected as shown below:

Column 3, line 39 - after "retaining" insert the word -- turbine.

Column 4, line 27 - the word "third" is spelled incorrectly.

Signed and Sealed this

Twenty-second Day of March 1977

[SEAL]

*Attest:*

RUTH C. MASON
*Attesting Officer*

C. MARSHALL DANN
*Commissioner of Patents and Trademarks*